United States Patent [19]

Rowen et al.

[11] Patent Number: 4,689,547

[45] Date of Patent: Aug. 25, 1987

[54] MULTIPLE LOCATION DIMMING SYSTEM

[75] Inventors: Michael J. Rowen, Philadelphia; Stephen J. Yuhasz, Zionsville; David L. Buehler, Lafayette Hill; Elliot G. Jacoby, Glenside; Joel S. Spira, Coopersburg, all of Pa.

[73] Assignee: Lutron Electronics Co., Inc., Coopersburg, Pa.

[21] Appl. No.: 857,739

[22] Filed: Apr. 29, 1986

[51] Int. Cl.[4] ..... G05F 1/455

[52] U.S. Cl. ..... 323/239; 323/272; 323/324; 323/905; 200/5 E; 200/160; 315/291; 315/DIG. 4

[58] Field of Search ..... 323/239, 241, 272, 322, 323/324, 325, 905, 909; 307/112, 113, 114, 115, 116, 132 E, 140; 200/5 B, 5 E, 160; 361/160; 315/291, DIG. 4; 364/492, 493

[56] References Cited

U.S. PATENT DOCUMENTS

| | | | |
|---|---|---|---|
| 3,746,923 | 7/1973 | Spira et al. | 338/179 |
| 4,259,619 | 3/1981 | Wall | 315/361 |
| 4,338,567 | 6/1983 | Yamazaki et al. | 315/291 |
| 4,563,592 | 1/1986 | Yuhasz et al. | 307/115 |
| 4,584,519 | 4/1986 | Gruodis | 323/300 |

OTHER PUBLICATIONS

High Power Modular Lighting Controllers Component by Lutron.
Electronic Light Dimmers S566A, S566B by Siemens.
Easyset Series 600W Installation Instructions by Lightolier Controls.
Paesar PRF Systems by Lutron.
Lutron Versaplex by Lutron.
High Power Modular Dimming Systems, DA Series by Lutron.

*Primary Examiner*—Peter S. Wong
*Assistant Examiner*—Judson H. Jones
*Attorney, Agent, or Firm*—Schiller, Pandiscio & Kusmer

[57] ABSTRACT

A multiple location system is provided for controlling application of alternating-current power to a load. The system employs a triac as a power carrying device, the gate control circuit for which has been modified to include auxiliary switching. Potentiometers are disposed at various different locations for determining, responsively to the setting or positioning of an actuator, such as the slide control of a linear potentiometer, the magnitude of respective control signals substantially immediately upon setting of the actuator. The signals are mutually exclusively applied to control the triac in accordance with which of the actuators is being set. Alternatively, the control signals can be applied in accordance with which one of a series of take-command switches (one for each location) was last operated. In either case, only two wires are necessary to connect the different locations to one another. In one embodiment, the actuator controls a pair of momentary-close switches associated therewith (e.g. such as a mechanical push button switch spring loaded so as to relax except when under pressure), the switch being ganged for alternative operation such that a first of the push buttons closes and the second remains open during movement of the potentiometer control slider in one direction, the first remaining open and the second being closed during motion of the slider in the other direction. The system includes a magnetic latching relay for conferring dimming control on that potentiometer control in which closure of one of the momentary-close switches has last occurred.

70 Claims, 8 Drawing Figures

MULTIPLE LOCATION DIMMING SYSTEM

This invention relates to a multiple location control system and more particularly to a novel multiple location electrical load dimmer system incorporating switching that permits any one of the dimmer control units of interest to assume control of the load.

Dimming devices operable from a plurality of locations are well known, as are switching systems that are operable from a plurality of locations to cause switching of an electrical load. For example, the "Versaplex" system of Lutron Electronics Co., Inc., uses multiple low voltage controls each having a "take command" switch. A large number of systems employ multiple raise/lower switches to operate motor controlled dimmers. Yet other systems are decribed in U.S. Pat. Nos. 3,697,821, 4,563,592 and others.

Typically, single location dimming with multiple switch location has been provided by a phase controlled dimmer with a manually operable, linearly or rotably movable potentiometer control, which dimmer may be combined with a series-connected single-pole, double-throw (three-way) switch in a wall box, and coupled with one or more series-connected three-way or four-way switches. In such a system all wiring and switches are rated to carry full load current. An alternative system is described in U.S. Pat. No. 4,563,592 that allows dimming from one location and switching from a plurality of locations. The wiring to the remote switching locations carries only signal power and the switches can be short-throw, light-force switches with a high tactile feel.

Alternatively, touch control systems have been provided in which each touch plate controls both switching and dimming level of a common dimmer. In such a system, one must wait until a newly desired light level is attained, and there is no indication of what the light level setting is when the lights are off. Such systems are sensitive to A.C. wiring polarity and loss of the previous switching and light level conditions in the event of temporary power loss. A serious disadvantage of such systems is that the touch plate wiring cannot be near load wiring. Some of these prior art systems generally require an overt act such as the deliberate manipulation of a separate switch, independently of the dimming control, as a distinct act or the part of the user to take command of control of the system at a given location.

Accordingly, a principal object of the present invention is to provide an electrical load dimming system incorporating switching that permits control of on-off and adjustment of lighting level at a plurality of locations, transfer of control being conferred among such locations automatically simply upon actuation of the lighting level adjustment by the user at the desired location. Other objects of the present invention are to provide such a dimming system in which the light level falls and rises immediately as the lighting level adjustment is manipulated by the user, i.e. without any delay such as is present in motor controlled dimmers; to provide such a dimming system in which the lighting level is established immediately by the position at which the lighting level adjustment is set by the user; to provide such a dimming system in which such lighting level control can occur at any of a plurality of locations; and to provide such a dimming system in which, in the event of a power supply failure, the lighting level status of the load and which one of a plurality of remote controls is in command are maintained. A further object of the present invention is to provide an electrical load dimming system incorporating switching that provides control of the on-off and adjustment of lighting level at a plurality of locataions independently of the setting of the actuators at the other locations, and with only two connecting wires between each location.

To effect these and other objects, the present invention generally comprises a novel multiple location system for controlling application of alternating-current power to a load, employing a controllable bidirectional switch as a power carrying device, such as a triac, the gate control circuit for which has been modified to include auxiliary switching. Means, such as potentiometers, (linear or rotary), or proximity detectors, are disposable at various different locations for determining, responsively to the setting or positioning of an actuator such as the slide control of a potentiometer, the magnitude of respective control signals substantially immediately upon setting of the actuator. The signals are mutually exclusively applied to control the bidirectional switch in accordance with which one of the actuators is being set. Alternatively, the control signals can be applied in accordance with which one of a series of take-command switches at each location was last operated. In one embodiment, the actuator controls a pair of momentary-close switching means associated therewith (e.g. such as a mechanical push button switch spring loaded so as to relax except when under pressure), the switching means being ganged or operable in tandem for alternative operation such that a first of the switching means or push buttons closes and the second remains open, for example during movement of a potentiometer control slider in one direction, the first remaining open and the second being closed during motion of the slider in the other direction. The system of the invention includes an auxilary switching circuit, for example a magnetic latching relay, for conferring dimming control on that potentiometer control in which closure of one of the momentary-close switching means has last occurred. Other auxiliary switching circuits are possible including the use of microcomputers for that purpose.

The present invention therefore advantageously provides dimming from a plurality of control locations in a continuous manner such that the current flowing to the load instantly tracks and is established by the position of one of a plurality of actuators. Further, transfer of control to one among the several actuators occurs simply upon manipulation of the actuator, and without any other overt act by the user. The system of the present invention is compatible with a wide variety of possible techniques for detecting actuator manipulation, such as electronic detection of slider motion, capacitive or other touch plates, breaking or reflecting optical or infrared beams, piezoelectric sensors, strain gauges, varying resistances and mechanical motion of a push button. Particularly advantageous is the ease with which the present invention can be retrofitted to existing three-way wiring systems that use three-way and four-way switches.

Other objects of the present invention will in part appear obvious and will in part appear hereinafter. The invention accordingly comprises the apparatus possessing the features, properties and relation of elements as exemplified in the following detailed disclosure and the scope of the application of which will be indicated in the claims.

For a fuller understanding of the nature and objects of the present invention, reference should be had to the following detailed description taken in connection with the accompanying drawings wherein.

Figure 1:
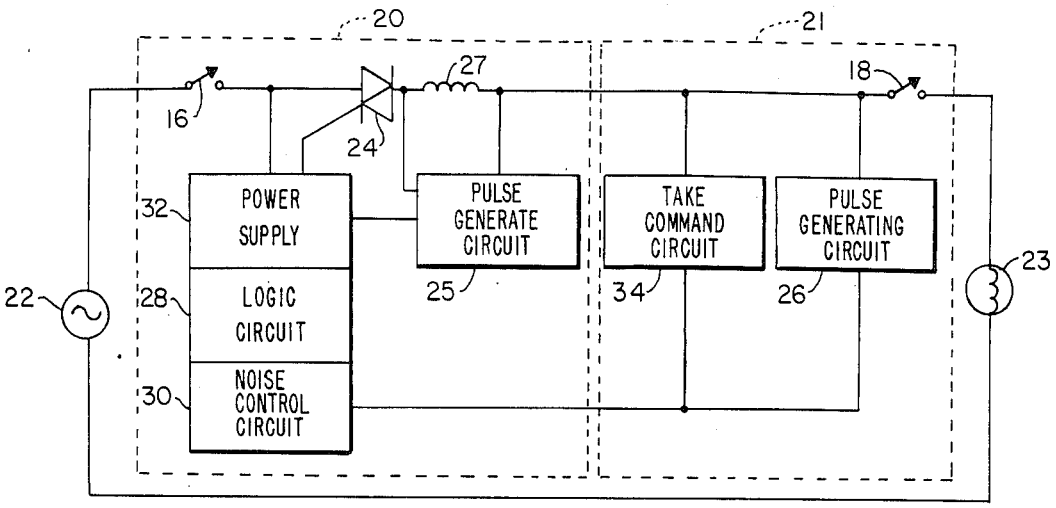
FIG. 1 is a block diagram showing the combination of elements embodying the principles of the present invention.

As shown in FIG. 1, one embodiment of the present invention comprises at least two light level control and on-off switching units, main unit 20 and remote unit 21, connected between AC source 22 and load 23 such as an incandescent lamp. Each unit can preferably be sized to fit within a standard electrical utility wall box and are connected to one another using only two wires. As will be apparent hereinafter from the detailed circuit schematic of FIG. 3, only control unit 20 includes power carrying means such as triac 24, one terminal of which is connected to source 22 through air-gap switch 16. The other terminal of triac 24 is connected to one side of load 23 through inductor 27 and air-gap switch 18.

Each of control units 20 and 21 includes pulse generating circuits, shown at 25 and 26 respectively, for controlling the operation of triac 24. Each pulse generating circuit in turn includes a light level adjustment actuator (shown in FIG. 3) that controls the setting of a potentiometer and hence controls the operation of the triac.

Main unit 20 further includes logic circuit 28 that functions to confer control of the system upon either main unit 20 or remote unit 21. Also included in unit 20 is noise control circuit 30 for processing the control signals received from remote unit 21, and power supply 32 for supplying power to logic circuit 28. Logic circuit 28, responsively to a signal generated when the light level adjustment activator in pulse-generating circuit 25 is moved, confers control of triac 24 to main unit 20.

Remote unit 21 includes take-command circuit 34 described in detail in connection with FIG. 3. Movement of the light level adjustment actuator in pulse-generating circuit 26 in remote unit 21 generates a signal that is processed by take-command circuit 34 and is then applied to logic circuit 28 in main unit 20 causing the logic circuit to confer control of triac 24 upon remote unit 21. Hence, the user of the system can control the light level at load 23 alternatively from either main unit 20 or remote unit 21 simply by the act of using the respective light level adjustment actuator, and without any other overt act.

Figure 2:
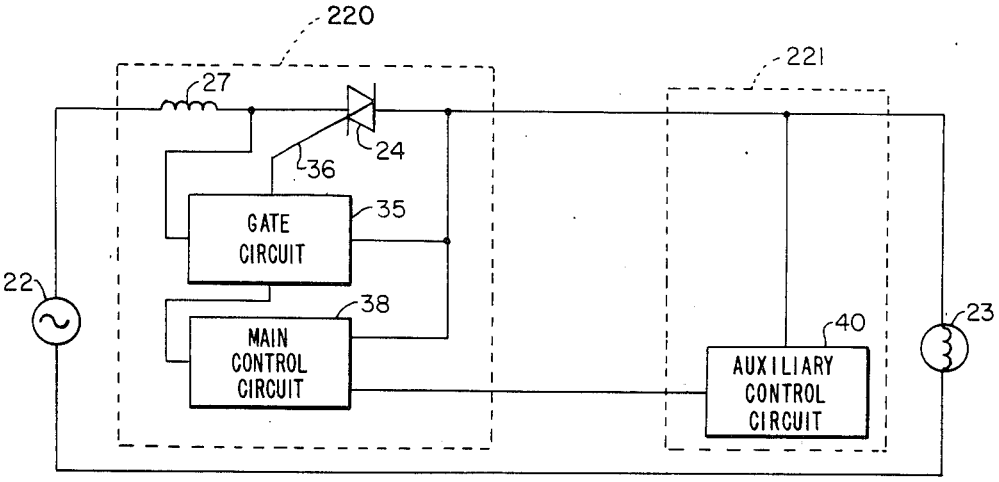
FIG. 2 is another block diagram showing an alternative combination of elements embodying the principles of the present invention.

In an alternative form of the present invention, as shown in FIG. 2, a single power carrying means 24 is also provided, exemplified by a triac or the like, one terminal of which is connectable to A.C. power source 22 through inductor 27. The other terminal of triac 24 is connectable to one side of load 23. The other side of load 23 is couplable to power source 22. As is well-known in the art, conduction by triac 24 can be controlled by gate circuit 35 connected to gate 36 and both main terminals of triac 24. Triac 24 and gate circuit 35 are included in main unit 220 which preferably further includes main control circuit 38. As will be seen in FIG. 4, main control circuit 38 comprises a power supply, logic circuit, and charging circuit. The charging circuit includes a light level adjustment actuator that controls the setting of a potentiometer and hence, in certain circumstances, can control gate circuit 35. The power supply powers the logic circuit.

The embodiment of FIG. 2 also includes remote unit 221 which comprises auxiliary control circuit 40. Remote unit 221 is connected to main unit 220 with only two wires. As will be seen in FIG. 4, auxiliary control circuit 40 comprises charging circuitry and take command circuitry. The charging circuitry of circuit 40 includes a light level adjustment member which controls the setting of a potentiometer. The logic circuit in main control circuit 38 serves to confer control of gate circuit 35 on either main control circuit 38 in main unit 220 or auxiliary control circuit 40 in remote unit 221, depending upon which potentiometer is being operated. Thus, as previously described in connection with the embodiment of FIG. 1, control can be transferred to the main unit or the remote unit by manipulating the appropriate light level adjustment member.

Figure 3:
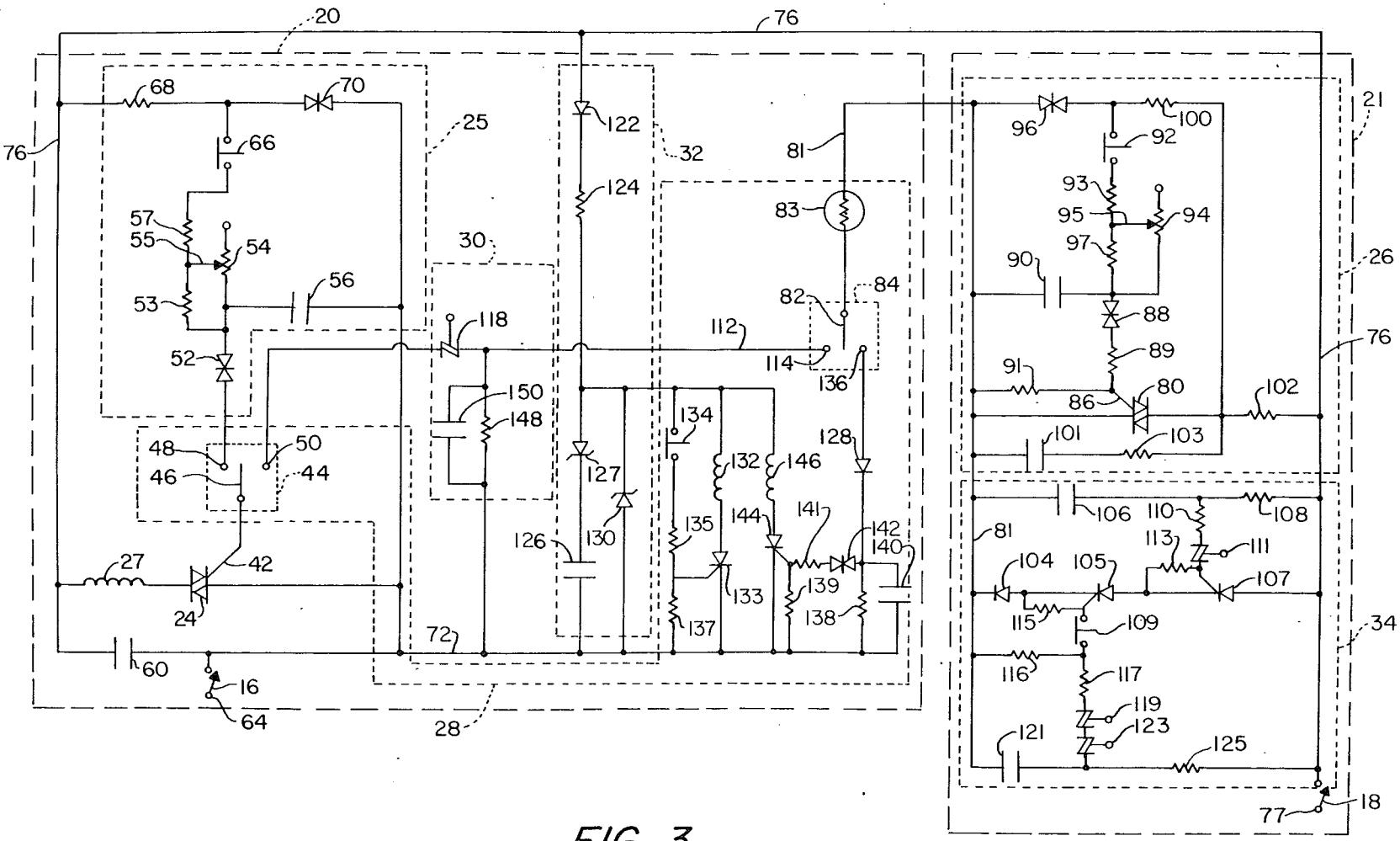
FIG. 3 is a circuit schematic of the embodiment of FIG. 1 showing detail of the present invention.

The dimming system shown in FIG. 3 is preferably a phase control system comprising main unit 20 and remote unit 21. Main unit 20 includes power carrying bilateral switch or triac 24 and pulse generating circuitry 25. Triac 24 is connected across a filter circuit comprising series-coupled capacitor 60 and inductor 27, the junction of capacitor 60 and triac 24 being connectable to hot terminal 64 of an AC source (not shown) through air-gap switch 16.

Pulse generating circuit 25 includes trigger device or diac 52, one side of which is connected to relay contact 48, the other side of which is connected to one side of potentiometer 54. As used herein, the term "potentiometer" is intended to include any variable resistor. The junction of diac 52 and potentiometer 54 is in turn coupled to one side of capacitor 56 and one side of calibration resistor 53. The movable contact of potentiometer 54 is connected to the other side of resistor 53 and to one side of high end trim resistor 57. The other side of resistor 57 is connected to one terminal of a normally closed, single pole, single-throw (SPST) momentary contact type switch 66. The other side of capacitor 56 is connected to line 72.

Switch 66 is mechanically operable by engagement with actuator 55 of potentiometer 54 at the low end of the travel of the actuator and thus serves as an electronic "off" switch to break the drive to gate 42 from the remainder of the phase control circuitry. The other terminal of switch 66 is connected to the junction of resistor 68 and one side of diac 70. The other side of diac 70 is connected to common line 72 that connects to the junction of triac 24 and capacitor 60. The other side of resistor 68 is connected to line 76 that connects to the junction between inductor 27 and capacitor 60.

Main unit 20 also includes logic circuit 28 comprising relay sections 44 and 84 which are mechanically coupled together. Relay section 44 includes relay armature 46 connected to gate terminal 42 and a pair of relay contacts 48 and 50. Relay contact 48 of relay section 44 is connected to pulse generating circuit 25. Relay section 84 includes relay armature 82 connectable alternatively to relay contacts 114 and 136. Logic circuit 28 also comprises series-connected relay coil 132 and silicon controlled rectifier (SCR) 133 connected in parallel to zener diode 130. One end of relay coil 132 is connected to the cathode of zener diode 130, the other end being connected to the anode of SCR 133. The cathode of the latter is connected to the anode of zener diode 130. The gate of SCR 133 is connected to the junction between resistors 135 and 137. The other side of resistor 137 is connected to line 72. The other side of resistor 135 is connected to one side of normally open SPST momentary push button type switch 134. The other side of switch 134 is connected to the cathode of zener diode 130. Switch 134 is mechanically coupled to actuator 55 of potentiometer 54 so that motion of the actuator momentarily closes switch 134. Relay contact 136 of relay section 84 is connected through diode 128 and resistor 138 to line 72, capacitor 140 being connected in parallel with resistor 138. The junction of capacitor 140, resistor 138 and the cathode of diode 128 is connected to one terminal of diac 142, the other terminal of the latter being connected to the gate of silicon controlled rectifier 144 through resistor 141. The anode of SCR 144 is coupled through relay coil 146 to the cathode of zener diode 130. The cathode of SCR 144 is connected to line 72. Resistor 139 is connected between the gate of SCR 144 and line 72. Relay coil 132 is disposed to cause armature 46 of relay section 44 to move into contact with relay contact 48 and armature 82 of relay section 84 to move into contact with relay contact 136. Relay coil 146 is provided for causing armature 46 of relay section 44 to move into contact with relay contact 50 and armature 82 of relay section 84 to move into contact with relay contact 114.

Main unit 20 also includes noise control circuit 30 which comprises silicon bilateral switch 118 connected in series between relay contact 114 of relay section 84 and relay contact 50 of relay section 44, capacitor 150 connected between line 72 and relay contact 114 of relay section 84, and resistor 148 connected in parallel with capacitor 150.

Power supply 32 in main unit 20 comprises diode 122, the anode of which is connected to line 76 and cathode of which is connected in series with resistor 124 to the anode of zener diode 127. The cathode of zener diode 127 is connected to one side of capacitor 126, the other side of the latter being connected to line 72. The junction of resistor 124 and zener diode 127 is connected to line 72 through zener diode 130.

Remote unit 21 comprises pulse-generating circuit 26 and take-command circuit 34. Pulse-generating circuit 26 of remote unit 21 comprises signal triac 80, one side of which is connected to line 81 that in turn is connected through PTC resistor 83 in main unit 20 to armature 82 of relay section 84 in main unit 20. Gate 86 of triac 80 is connected in series through resistor 89, diac 88 and capacitor 90 to line 81. The junction of diac 88 and capacitor 90 is connected through calibration resistor 97 and high end trim resistor 93 to one side of normally closed, SPST momentary contact type switch 92. The latter is similar in function to switch 66, being mechanically coupled to actuator 95 of potentiometer 94 to open at the low end of the actuator travel and break the gate drive to triac 80. The other side of switch 92 is connected in series through diac 96 to line 81. The junction of switch 92 and diac 96 is connected through resistors 100 and 102 to line 76. One side of potentiometer 94 is connected to the junction between diac 88, capacitor 90 and resistor 97. The movable contact of potentiometer 94 is connected to the junction between resistors 93 and 97. Resistor 102 is connected between the other side of triac 80 and line 76. Resistor 91 is connected between line 81 and gate 86 of triac 80. Snubber resistor 103 is connected from the junction of triac 80 and resistor 102 through snubber capacitor 101 to line 81.

Take-command circuit 34 in remote unit 21 includes series connected capacitor 106 and resistor 108 which connect line 81 and line 76 and are thus in parallel with the series combination of triac 80 and resistor 102.

Line 76 is also connected to the anode of SCR 107, the cathode of SCR 107 being connected to the anode of SCR 105. The cathode of SCR 105 is connected to the anode of diode 104 and the cathode of diode 104 is connected to line 81. One side of silicon bilateral switch 111 is connected to the gate of SCR 107, the other side of silicon bilateral switch 111 being connected through resistor 110 to the junction of resistor 108 and capacitor 106. Gate resistor 113 is connected between the gate and cathode of SCR 107. The gate of SCR 105 is connected to one side of normally open SPST momentary push-button type switch 109. The other side of switch 109 is connected through resistor 116 to line 81. Switch 109 is mechanically coupled to actuator 95 of potentiometer 94 so that the motion of the actuator serves to close switch 109 for as long as the actuator is in motion. Gate resistor 115 is connected between the gate and cathode of SCR 105. One side of resistor 117 is connected to the junction of switch 109 and resistor 116. The other side of resistor 117 is connected through bilateral switches 119 and 123 to the junction of resistor 125 and capacitor 121. The other side of resistor 125 is connected to line 76. The other side of capacitor 121 is connected to line 81.

Main unit 20 and remote unit 21 are connected by lines 76 and 81. Line 76 is connected to terminal 77 through air-gap switch 18.

The operation of the system of FIG. 3 is as follows:

In the power supply for the system, diode 122 permits current flow through resitor 124, zener diode 127 and capacitor 126 only during each negative half-cycle of the source voltage. Resistor 124 limits the current flow into capacitor 126 and also is preferably sized to prevent more than six volts appearing across capacitor 126 when either switch 134 is closed or SCR 144 is on for more than ten milliseconds. Zener diode 130 clamps the voltage across capacitor 126 and zener diode 127 so that capacitor 126 may be charged through diode 122, resistor 124 and zener diode 127, up to the zener voltage (e.g. 24 volts) and provide power for relay coils 132 and 146. Zener diode 127 has a zener voltage of about six volts and prevents capacitor 126 from discharging unless it has at least this voltage across it.

If initially armature 46 of relay section 44 is in contact with relay contact 50 and armature 82 of relay section 84 is in contact with relay contact 114, movement of actuator or slide operator 55 of potentiometer 54 serves to close pushbutton switch 134 for as long as the actuator is moving, causing capacitor 126 to discharge through resistor 135 into the gate of SCR 133. This turns SCR 133 on and pulses relay coil 132, resistor 137 preventing dv/dt firing of SCR 133. When relay coil 132 is thus pulsed, relay armatures 46 and 82 are respectively disconnected from relay contacts 50 and 114 and the armatures are connected with relay poles 48 and 136 respectively instead. This switching confers command of the system upon main unit 20. If relay contacts 48 and 136 were originally in contact with their respective relay armatures, pulsing of coil 132 would have no effect on the relay sections.

With main unit 20 in command, capacitor 56 will charge up to the breakover voltage of diac 52 in a time dependent upon the resistance set by potentiometer 54, resistor 57, resistor 53 and the capacitance of capacitor 56. When the charge on capacitor 56 reaches the diac breakover voltage (ca. 29 to 37 volts), diac 52 discharges capacitor 56 into gate terminal 42. The discharge through diac 52 into gate 42 turns triac 24 on and puts line voltage at terminal 77 which may be connected to a load.

Diac 70 functions as a bi-directional zener diode to regulate the power supply used to create the time delay established by potentiometer 54, capacitor 56, and resistors 53 and 57. Voltage compensation is also achieved through the negative resistance characteristics of diac 70 while it is conducting. Resistor 68 limits the current flowing into the timing circuit provided by potentiometer 54, capacitor 56, and resistors 53 and 57, biases the operating point of diac 70 for maximum voltage compensation, and limits the current flowing into diac 70.

Triac 24 serves as the power-carrying component of the system. As is well known, triac 24 turns on when gate terminal 42 is pulsed with current, and turns off when the current flowing through the triac falls to zero. In order to minimize generation of high frequency noise, capacitor 60 and inductor 27 serve as a filter wherein the capacitor reduces voltage spikes and the inductor limits current surges that may occur when triac 24 turns on.

Capacitor 106 in remote unit 21 will be charged to a voltage greater than the breakover voltage of bilateral switch 111 whenever main unit 20 is in command. This occurs because diode 128 in main unit 20 is in series with capacitor 106 and resistor 108, allowing a net D.C. voltage to appear across remote unit 21. Thus, SCR 107 is gated on by capacitor 106 discharging though limiting resistor 110 and silicon bilateral switch 111 whenever main unit 20 is in command, but it cannot turn on and conduct current until SCR 105 turns on. If remote unit 21 is in command, diode 128 is no longer in series with capacitor 106 and resistor 108, and no net D.C. voltage can appear across capacitor 106. Hence the breakover voltage of bilateral switch 111 is never reached and SCR 107 cannot turn on. Gate resistor 113 prevents dv/dt firing of SCR 107.

Resistor 125 and capacitor 121 form a short time-constant timing network that acts with silicon bilateral switches 123 and 119 to put a pulse of current through resistor 116 several times during each half cycle. Whenever capacitor 121 charges to a voltage greater than the sum of the breakover voltages of switches 123 and 119, the latter conduct and capacitor 121 discharges through limiting resistor 117 and thus through resistor 116.

If now actuator or slide control 95 of potentiometer 94 in remote unit 21 is moved, it closes switch 109 for as long as it is in motion. Hence, the next time capacitor 121 discharges in a negative half-cycle, SCR 105 will be gated on. These are the only conditions under which SCR 105 can turn on. SCR 107 is also gated on under these conditions as described above. Hence control line 81 is momentarly raised to whatever potential is on line 76. Gate resistor 115 prevents dv/dt firing of SCR 105, and diode 104 protects SCR 105 from reverse voltage.

Since main unit 20 is still in control, line 81 is connected at this point, through PTC resistor 83, armature 82, contact 136 of relay section 84, and diode 128 to diac 142. Enough voltage is thus provided to charge capacitor 140 up to the breakover voltage of diac 142 which then breaks into conduction. PTC resistor 83 serves to protect main unit 20 from the effects of miswiring during installation.

Switch 142 then discharges capacitor 140 through limiting resistor 141 into the gate of silicon-controlled rectifier 144, turning the later on and discharging capacitor 126 through zener diode 127 and relay coil 146. When relay coil 146 is pulsed, relay armatures 46 and 82 are disconnected from relay contacts 48 and 136 respectively and become connected to relay contacts 50 and 114 respectively conferring control of the system upon remote unit 21. It should be noted that only two lines, 76 and 81, are required to couple units 20 and 21.

Note that capacitor 140 can charge to the breakover voltage level of diac 142 only when SCR 15 and SCR 107 are in conduction. Resistor 138 acts as a bleed to prevent noise or leakage currents from falsely tripping silicon-controlled rectifier 144 into conduction. Gate resistor 139 is intended to prevent dv/dt firing of SCR 144.

When remote unit 21 is in command, relay armature 82 is connected to relay contact 114, and relay armature 46 is connected to relay contact 50 as noted above. Hence, pulse-generating circuit 26 in remote unit 21 is connected to the gate 42 of triac 24 through PTC resistor 83 and silicon bilateral switch 118.

The operation of pulse-generating circuit 26 is as follows:

Capacitor 90 charges to the breakover voltage of diac 88 on a time-dependent basis according to the setting of potentiometer 94 and the values of resistor 93, resistor 97 and capacitor 90. When diac 88 conducts, it discharges capacitor 90 through limiting resistor 89 into gate terminal 86 of triac 80. Triac 80 then turns on, charging up capacitor 150 until the breakover voltage of silicon bilateral switch 118 is reached, at which time current flow into gate terminal 42 of triac 24 turning it on and applying line voltage to terminal 77. Hence, when remote unit 21 is in command, triac 80 acts as a signal or low current pilot triac that fires main triac typically about fifty microseconds after triac 80 fires, at which time the pilot triac turns off.

When triac 80 is not conducting, resistor 148 limits the voltage on capacitor 150 to less than the breakover voltage of silicon bilateral switch 118.

Triac 80 is gated on even when control circuit 25 is in command. Resistor 102 is sized such that capacitor 140 is prevented from charging to a voltage greater than the breakover voltage of diac 142 each time triac 80 conducts. This prevents false signals from gating SCR 144 on. Regardless of whether main unit 20 or remote unit 21 is in command, the voltage at terminal 77 is phase-controlled by triac 24. Resistor 102 has sufficient power-handling capability to carry, without failing, any currents that might flow under miswire conditions.

Air-gap switches 16 and 18 provide isolation of the load from the small leakage current that flows through triac 24, even when the latter is in its blocking state, from either the main or remote unit. Switches 16 and 18 are closed during normal operation and are not a critical feature of the invention.

Because relay sections 44 and 84 are parts of the same latching relay and the settings of potentiometers 54 and 94 remain unaffected, should the line power fail, the status of the system will be unchanged. Upon restoration of power, the system will immedately assume the same state as existed at the time of power failure.

It will be appreciated that potentiometers 54 and 94 are simply variable resistances that can be linear potentiometers or rotary potentiometers as desired. In either event, the actuator for the particular potentiometer should be manipulable, either manually or by remote control if desired, through a plurality of positions for setting the control signals produced at a like plurality of values corresponding to the positions. The setting of each potentiometer should extend across a range between minimum and maximum values that can be adjusted with high end trimming resistors 57 and 93, and calibration resistors 53 and 97.

It should be noted that it is not necessary to make any connection to neutral for the purpose of powering the dimming system described. All the power required is obtained from the voltage across triac 24 both during the on and the off states. In essence, the system operates by automatically connecting pulse-generating circuit 25 or pulse-generating circuit 26 (plus associated components in the main unit) to gate 42 of triac 24 depending upon which potentiometer actuator 55 or 95 was last moved.

The presently preferred values of the resistors and capacitors of the embodiment of FIG. 3 are set forth in Table I below. All resistors are 0.5 W power rating unless otherwise stated.

TABLE I

| Resistor | Value (ohms) | Capacitor | Value (uf) | Rated Voltage |
|---|---|---|---|---|
| 53 | 120K-220K(Sel) | 56 | .047 | 250 |
| 54 | 0-250K(Var) | 60 | .047 | 250 |
| 57 | 10K | 90 | .047 | 250 |
| 68 | 27K | 101 | .01 | 250 |
| 89 | 100 | 106 | .047 | 250 |
| 91 | 100 | 121 | .01 | 50 |
| 93 | 10K | 126 | 4.7 | 50 |
| 94 | 0-250K(Var) | 140 | .22 | 50 |
| 97 | 120K-220K(Sel) | 150 | .47 | 50 |
| 100 | 27K | | | |
| 102 | 3K(5 W) | | | |
| 103 | 1K | | | |
| 108 | 1.5 M | | | |
| 110 | 1K | | | |
| 113 | 1K | | | |
| 115 | 1K | | | |
| 116 | 3.3K | | | |
| 117 | 220 | | | |
| 124 | 27K(1 W) | | | |
| 125 | 120K | | | |
| 135 | 1K | | | |
| 137 | 1K | | | |
| 138 | 470 | | | |
| 139 | 1K | | | |
| 141 | 1K | | | |
| 148 | 750 | | | |

Preferably, all diodes are type 1N4004; all silicon bilateral switches are Motorola MBS 4992; all silicon controlled rectifiers are Motorola MCR 22-5; triacs 24 and 80 are respectively Motorola MAC 223-5 and MAC97AB. Also preferably, diacs 52, 88 and 142 are NEC N413(M) with a breakover voltage of 30 V; diacs 70 and 96 are Teccor HT1010 with a breakover voltage of 60 V.; zener diode 127 is type 1N5232B with a $V_z$ of 5.6 V; zener diode 130 is type 1N5256B with a $V_z$ of 30 V. Inductor 27 is 50 $\mu$H. PTC resistor 83 is a Murata ERie PTH59G14AR331M150. Relay section 44, relay section 84, relay coil 132 and relay coil 146 together are preferably in the form of an Aromat relay DS2ESL2DC12V.

Figure 4:
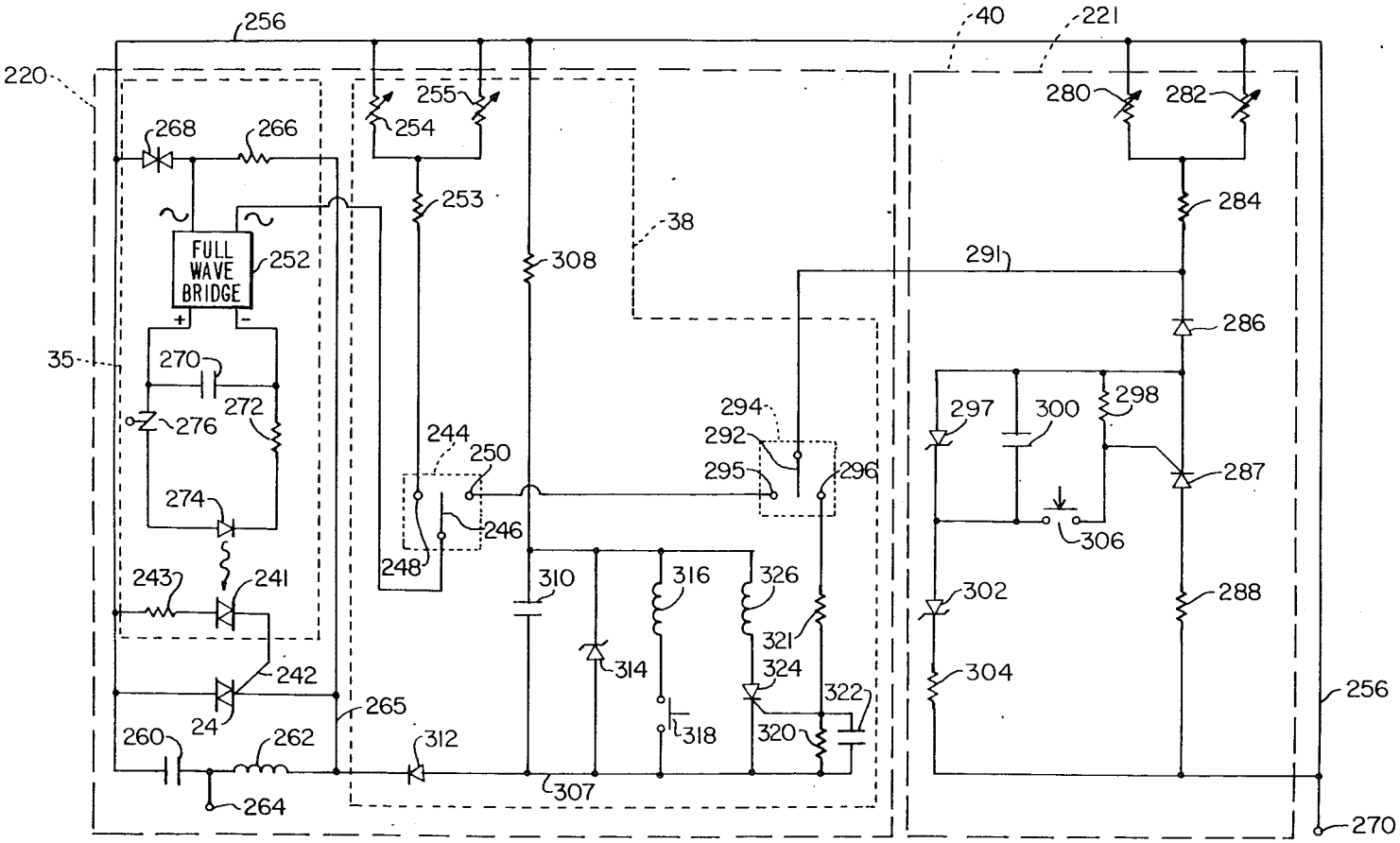
FIG. 4 is a circuit schematic of the embodiment of FIG. 2 of the present invention.

The dimming system shown in FIG. 4 is also preferably phase-controlled and includes main unit 220 and remote unit 221. Main unit 220 includes power-carrying bilateral switch or triac 24. Triac 24 is connected across a filter circuit comprising series-coupled capacitor 260 and inductor 262, the junction of impedances 260 and 262 being connectable to hot terminal 264 of an AC source (not shown in this Figure). The free end of inductor 262 is connected to main terminal one of triac 24 and to line 265.

Gate terminal 242 of triac 24 is connected to gate circuit 35 comprising light-activated triac 241 in series with one terminal of resistor 243. The other terminal of resistor 243 is connected to line 256. Circuit 35 also includes series-connected resistor 266 and diac 268. The free terminal of diac 268 is connected by line 256 to one side of triac 24. The free terminal of resistor 266 is connected to line 265. The junction of series resistor 266 and diac 268 is connected to one AC terminal of bridge 252. Capacitor 270 is connected across the positive and negative terminals of bridge 252. The negative terminal of bridge 252 is connected through series resistor 272 to the cathode of light-emitting diode 274, the anode of the latter being connected through a trigger device such as silicon bilateral switch 276 to the positive terminal of bridge 252. The other A.C. terminal of bridge 252 is connected to armature 246 of relay section 244.

Main control circuit 38 comprises a power supply, logic circuitry and charging circuitry. The power supply for the dimming system of the present invention comrises series connected resistor 308 and capacitor 310 connected between lines 256 and 307. Line 307 in turn connects to the anode of diode 312, the cathode of the latter being connected to line 265. The junction of resistor 308 and capacitor 310 is connected to the cathode of zener diode 314. The anode of zener diode 314 is connected to line 307.

The logic circuitry that controls which of the two control units is in command comprises series-connected relay sections 244 and 294 (which are mechanically coupled together) and relay coils 316 and 326 and their associated circuitry. Normally open SPST momentary pushbutton-type switch 318 is connected in series with relay coil 316. The free terminal of coil 316 is connected to the cathode of zener diode 314. The free terminal of switch 318 is connected to the anode of zener diode 314. Switch 318 is mechanically coupled to the actuator of potentiometer 254 so that switch 318 closes when the actuator is in motion. Relay contact 296 of relay section 294 is connected through series resistors 321 and 320 to line 307. One side of capacitor 322 is connected to the junction of resistors 320 and 321, the other side being connected to line 307. The former junction is also connected to the gate of silicon controlled rectifier 324. The anode of SCR 324 is coupled through relay coil 326 to the junction of capacitor 310 and resistor 308. The cathode of silicon-controlled rectifier 324 is connected to line 307.

Relay section 294 is ganged with relay section 244 (both air-gap switches) so that if armature 292 of switch 294 is in contact with relay contact 296, armature 246 of relay section 244 is in contact with relay contact 248. When the armatures are thus arranged, the main control circuit controls the triggering of triac 24, and thus the power being fed to the load. Similarly, when armature 292 is in contact with relay contact 295, armature 246 is in contact with relay contact 250. When the armatures are in this latter position, the auxiliary control circuit controls the triggering of triac 24, and thus the power flow to the load. Relay coil 316 is the relay coil that causes armature 246 to contact relay contact 248 and armature 292 to contact relay contact 296. Relay coil 326 is the relay coil that causes armature 246 to contact relay contact 250 and armature 292 to contact relay contact 295. Relay contact 295 of relay section 294 is connected to relay contact 250 of relay section 244.

The charging circuitry comprises a pair of parallel variable resistors, slide potentiometer 254 and trim potentiometer 255, one junction of which is connected to one side of resistor 253. The other junction of potentiometers 254 and 255 is connected to line 256 which in turn is connected both to one side of triac 24 and to one side of resistor 243. The other side of resistor 253 is connected to relay contact 248 of relay section 244.

Remote unit 221 comprises auxiliary control circuit 40 which in turn comprises take-command circuitry and charging circuitry. The take-command circuitry includes SCR 287. The anode of SCR 287 is connected through resistor 288 to line 256 adjacent dimmed hot terminal 270. The cathode of SCR 287 is connected to the anode of diode 286.

The anode of diode 286 is also connected directly to the anode of zener diode 297 and connected through resistor 298 to the gate of SCR 287. Capacitor 300 is coupled in parallel with zener diode 297. The cathode of zener diode 297 is connected to the anode of zener diode 302, the cathode of the latter being connected through resistor 304 to line 256. The gate of SCR 287 is connectable through normally open SPST momentary pushbutton-type switch 306 to the junction of the anode of diode 302 and the cathode of diode 297. The cathode of diode 286 is connected through line 291 to relay armature 292 of relay section 294 in the main unit.

The charging circuitry in remote unit 221 includes another pair of parallel variable resistors, slide potentiometer 280 and trim potentiometer 282, one junction of which is connected to line 256, the other junction of which is connected to one side of limiting resistor 284. The other side of resistor 284 is connected to the cathode of diode 286.

The operation of the system of FIG. 4 is as follows:

In the power supply for the system, diode 312 permits current to flow through resistor 308 and capacitor 310 only during each negative half cycle. Resistor 308 limits the current flow into capacitor 310 and also is preferably sized to prevent more than six volts appearing across relay coils 316 or 326 when switch 318 is closed or SCR 324 is conducting for more than 10 milliseconds. Zener diode 314 clamps the voltage across capacitor 310 so that the latter may be charged through resistor 308 up to the zener voltage, and provide power for relay coils 316 and 326.

One may assume that armature 246 of relay section 244 is initially in contact with relay contact 250 and armature 292 of relay section 294 is in contact with relay contact 295. The actuator for potentiometer 254 is mechanically coupled to switch 318 so the latter is operable upon motion or manipulation of the actuator. Potentiometer 255 serves simply as a trimming device to adjust the limits of the setting of potentiometer 254. Thus, movement of the actuator or slide operator of potentiometer 254 serves to close pushbutton switch 318, causing capacitor 310 to discharge through relay coil 316. Pulsing of relay coil 316 causes relay armatures 246 and 292 to be respectively disconnected from relay contacts 250 and 295. The armatures then become connected to relay contacts 248 and 296 respectively instead, conferring command of the system upon main control circuit 38. Pulsing of coil 316 clearly has no effect on the relay armatures if the latter are in the position where main control circuit 38 is in command.

Bridge 252 serves to provide full-wave rectification of the charging current suppied to capacitor 270. Capacitor 270 and potentiometer 254 provide a timing circit that controls the rate at which charge on capacitor 270 is built up, until the breakover or trigger voltage threshold of silicon bilateral switch 276 is exceeded, upon which capacitor 270 discharges through light-emitting diode 274. Diac 268 functions as a bi-directional zener diode to regulate the power supply used to create the time delay established by potentiometer 254 and capacitor 270. Voltage compensation is also achieved through the negative resistance characteristics of diac 268 when it is conducting. Resistor 266 limits the current flowing into the timing circuit provided by potentiometer 254 and capacitor 270, biases the operating point of diac 268 for maximum voltage compensation, and limits the current flowing into diac 268.

Triac 24 serves as the power-handling component of the system, turning on when gate terminal 242 is pulsed, and turning off when the current through the triac falls to zero. Capacitor 260 and inductor 262 serve as a filter. The discharge of capacitor 270 through diode 274 causes the latter to emit a pulse of visible or infrared radiation that is absorbed by light-activated triac 241. The latter then conducts and applies a pulse into gate 242, turning triac 24 on. As is well kown, the timing of the pulses by which triac 24 is turned on can be varied by changing the setting of potentiometer 254 to produce a phase-control system that governs the power applied at terminal 270 which may be connected to a load.

Movement or setting of the actuator of potentiometer 280 in the remote unit closes switch 306 for as long as the motion occurs. If capacitor 300 is charged to an appropriate voltage, the closure of switch 306 will discharge the capacitor into the gate of silicon-controlled rectifier 287, turning the latter on. Thus, a current path is provided through resistor 288, silicon-controlled rectifier 287 and diode 286 through switch armature 292, contact 296 and resistor 321 to the gate of silicon-controlled rectifier 324. The dimmed hot voltage is present at terminal 270, so sufficient current is thus provided to charge capacitor 322 to the trigger voltage for the gate of silicon-controlled rectifier 324, turning the latter on and discharging capacitor 310 through relay coil 326. When relay coil 326 is pulsed, relay armatures 246 and 292 disconnect from their relay contacts 248 and 296 respectively and become connected to relay contacts 250 and 295 respectively, so that command of the system is assumed by auxiliary control circuit 40. Diodes 297 and 302 together with resistor 304 assure that capacitor 300 will remain charged at a limiting value during command of the system by main control circuit 38.

This, however, is not the case when auxiliary control circuit 40 is in command. The zener voltage of zener diode 302 is greater than the breakover voltage of diac 268. When auxiliary control circuit 40 is connected to full-wave bridge 252, only the diac voltage appears across auxiliary control circuit 40 and is insufficient to allow zener diode 302 to conduct.

In this configuration, potentiometers 280 and 282 in the remote unit together with capacitor 270 in the main unit, provide the timing circuit.

Resistor 284 in the remote unit is sized to prevent capacitor 322 in the main unit from charging to a voltage greater than the gate voltage of SCR 324 while main unit 220 is in command, thus preventing false signals from gating SCR 324 on.

It should be noted that the circuit embodied in FIG. 4 includes a single phase-control gate circuit basically controlled by variation of the resistance values of the respective potentiometers in each control circuit. The control signal provided then by control circuit 40 will be the variable current of a few milliamperes peak on control line 291 used to charge capacitor 270. Line 291, however, is very susceptible to noise typically generated by long capacitively coupled lines which lines 256 and 291 are. Currents induced by such capacitive coupling may be of the order of the standard control-line current flow, and hence might tend to interfere with the performance of the system when remote unit 221 is in command. The embodiment of FIG. 3 solves this problem by adding phase control timing circuitry (basically triac 80 and the associated circuit elements) to remote unit 221, thereby allowing line 81 to carry larger peak pulse currents produced by triac 80. The embodiment of FIG. 3 produces variable phase signals, while the embodiment of FIG. 4 produces variable amplitude signals.

The prefrred values of the resistors and capacitors of the ebodiment of FIG. 4 are set forth in Table II below. All resistors are 0.5 W power rating unless otherwise stated.

TABLE II

| Resistor | Value (ohms) | Capacitor | Value (uf) | Rated Voltage |
|---|---|---|---|---|
| 243 | 100 | 260 | 1 | 200 |
| 253 | 27K | 270 | 0.33 | 200 |
| 254 | 0-250K(Var) | 310 | 4.7 | 50 |
| 255 | 0-500K(Var) | 322 | .1 | 5 |
| 266 | 27K | 350 | .047 | 50 |
| 272 | 150 | | | |
| 280 | 0-250K(var) | | | |
| 282 | 0-500K(Var) | | | |
| 284 | 27K | | | |
| 288 | 3.9K | | | |
| 298 | 1K | | | |
| 304 | 39K | | | |
| 308 | 27K(1 W) | | | |
| 320 | 50 | | | |
| 321 | 1K | | | |

Preferably, all diodes are type 1N4004; all silicon bilateral switches are Motorola MBS 4992; all silicon controlled rectifiers are Motorola MCR 22-5; triac 24 is Motorola 223-5. Also preferably, diac 268 is Teccor HT1010 with a breakover voltage of 60 V.; zener diodes 297 and 314 are type 1N5256B with a $V_z$ of 30 V. Zener diode 302 is a type 1N5267B with a $V_z$ of 75 V. Bridge 252 is rated at 1 Amp, 400 V. Inductor 262 has an inductance of 50 μH. Optical triac 241 and light emitting diode 274 together are exemplified by a Motorola MOC3021. Relay section 244, relay section 294, relay coil 316 and relay coil 326 together are preferably in the form of an Aromat relay DS2ESL2DC12V.

Figure 5:
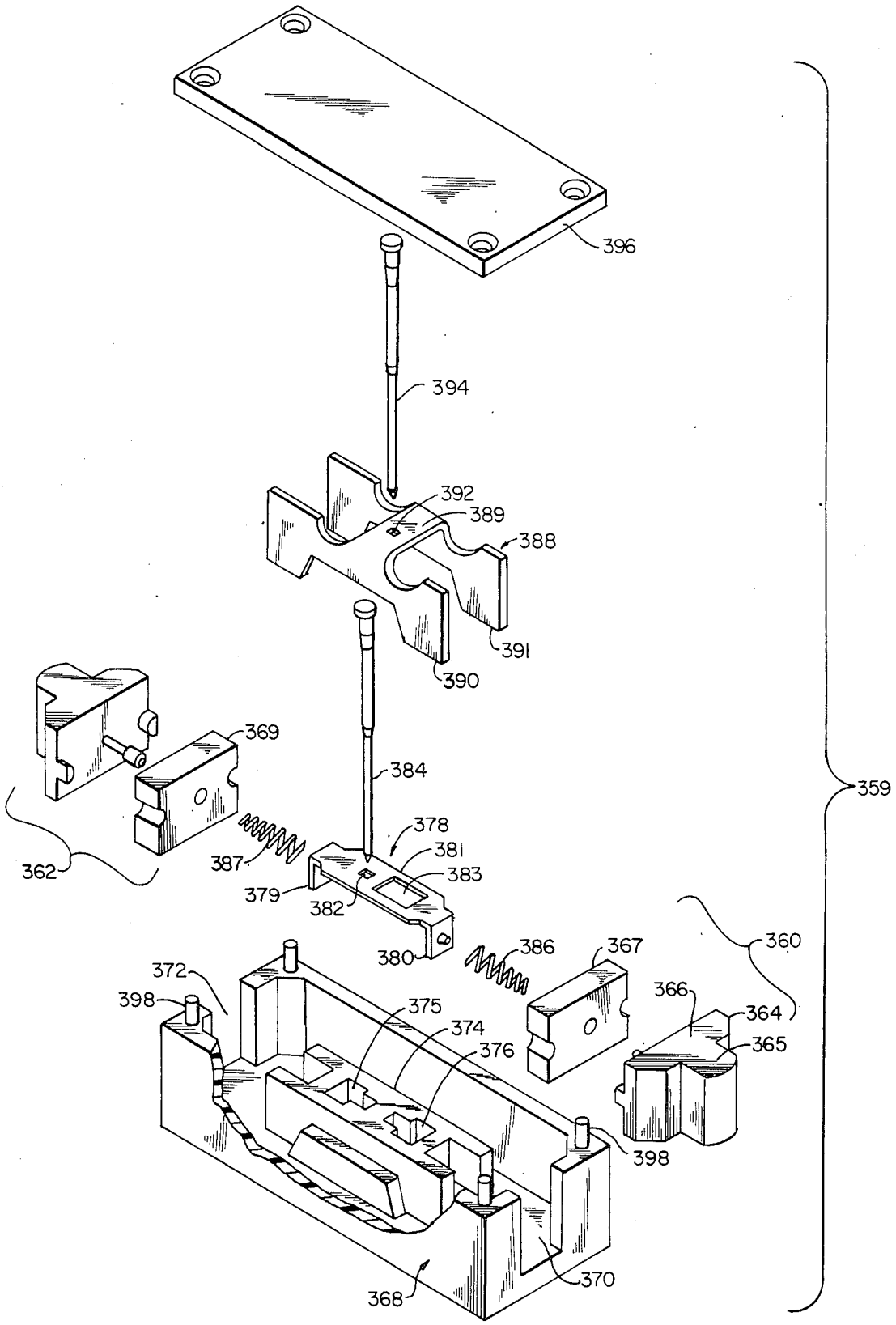
FIG. 5 is an exploded view of a push-button switch useful with the present invention.

In FIG. 5, there is shown an exploded detail of single pole, single throw, dual, in-line momentary pushbutton-type switch 359, typified by switch 109 in FIG. 3, and including a pair of independently movable buttons 360 and 362. Each of the buttons, exemplified by button 360, has an electrically insulating body 364 with a T-shaped cross-section including an extended base 365 and cross-top 366. The outer end of top 366 of body 364 is faced with an electrically conductive, energy-absorbing resilient layer 367 such as rubber loaded with metal or carbon particles.

Switch 359 also includes cradle 368 in the form of an elongated rectangular box, the top of which is open, and the ends of which have respective vertical slots 370 and 372. Slots 370 and 372 are dimensioned and shaped so that extended base 365 respectively of buttons 360 and 362 can slidingly fit therein, the buttons being captured inside cradle 368 by engagement of respective ends 366 with the interior walls of the cradle adjacent each of the slots. Disposed substantially centrally within cradle 368 is fixed connector mount 374. The latter is preformed with holes 375 and 376 extending vertically and substantially parallel to the vertical axes of slots 370 and 372. Sufficient clearance is left around the periphery of mounting block 374 to permit each end 366 and layer 367 of the respective buttons to fit between the interior walls of the ends of cradle 368 and the respective facing ends of mounting block 374 with clearance sufficient to permit each base 365 of each button to be movable horizontally between the interior edges of each slot and the corresponding facing end of block 374. Cradle 368 and mounting block 374, which is preferably formed integrally therewith, are formed of an electrically insulating material, typically of a molded plastic.

Switch 359 also includes spring retainer 378 typically formed of flat, sheet metal stock, preferably gold-plated brass, or other electrically conductive material. Retainer 378 has elongated, rectangular, substantially flat central portion 381 with two depending contact arms 379 and 380 extending from the shorter edges of portion 381 substantially parallel to one another in the same direction perpendicular to the plane of portion 381. Section 381 of retainer 378 is provided with a pair of holes 382 and 383.

Retainer 378 is intended to be mounted on top of mounting block 374 with hole 382 registered with hole 375. Hole 382 is of substantially the same cross-sectional diameter as that of the upper portion of connector pin 384 such that when inserted through hole 382, connector pin 384 is locked to retainer 378, forming a permanent electrical connection. Hole 383, on the other hand, is preferably dimensioned to be substantially much larger than hole 376, and is disposed so that when retainer 378 is mounted on block 374, hole 376 is positioned substantially centrally in register with hole 383.

A pair of compression or coil springs 386 and 387, formed of electrically conductive material preferably gold-plated, are provided and intended to be mounted respectively, one between contact arm 380 of retainer 378 and the corresponding electrically conductive layer 367 of button 360, the other in similar manner between contact arm 379 and the corresponding electrically conductive layer 369 of button 362. The interior ends of springs 386 and 387 are located and retained over the nipple projections on contact arms 379 and 380; the exterior ends of springs 386 and 387 are located and retained over the posts extending inwardly from pushbuttons 360 and 362. Springs 386 and 387 thereby serve to resiliently bias the respective buttons into engagement with the interior end walls of cradle 368 adjacent the sides of slots 370 and 372, and also provide an electrical connection between respective conductive layers 367 and 369, and retainer 378. It will be seen that layers 367 and 369, springs 386 and 387 and retainer 378 thereby form a pair of movable, electrical contacts of the switch.

Switch 359 further comprises electrically conductive contact member 388, also formed preferably of flat sheet metal stock, preferably gold-plated brass or other electrically conductive material. Member 388 includes flat, elongated, rectangular center portion 389 from the sides of which extend two depending legs 390 and 391 in the same direction parallel to one another and perpendicular to the plane of center portion 389, thereby forming a trough or channel. It will be seen that the ends of contact member 388 lie in parallel planes with one another perpendicularly to the long axis of the trough. Contact member 388 is dimensioned and shaped so that depending legs 390 and 391 fit readily within the interspace between the interior sides of cradle 368 and the sides of mounting block 374. Contact member 388 also includes hole 392 in center portion 389. Hole 392 is positioned and dimensioned so that then the contact member is mounted in cradle 368 with legs 390 and 391 positioned adjacent the exterior sides of block 374, hole 392 is registered with hole 376. Hole 392 is of substantially the same cross-sectional diameter as that of the upper portion of pin 394 such that the latter can be pushed through hole 392 and into hole 376 without contacting the interior periphery of hole 383, thus locking the contact member to pin 394 and forming a permanent electrical connection. Legs 390 and 391 are sufficiently separated from one another so that they fit snugly against the exterior sides of block 374, but are spaced from and do not contact retainer 378. Contact member 388 is also dimensioned so that the edges at opposite ends of contact member 388 are spaced from layers 367 and 369 of buttons 360 and 362 when the latter are spring-biased against the respective ends of cradle 368.

Electrically conducting layers 367 and 369 are located and permanently attached to buttons 360 and 362 without the use of adhesive, preferably by a system formed of a harpoon center post and two antirotation nubs on the face of the pushbuttons. Electrically conducting layers 367 and 369 are further retained by biasing springs 386 and 387 which slip over the harpoon tip and press against the respective conductive layer.

Electrically insulating cover 396 is dimensioned and shaped to be fitted over the open top of cradle 368 and held there by appropriate mounting means such as pins 398. Cover 396 has bosses (not shown) protruding from the bottom surface thereof and serving to maintain the proper positioning of contact members 378 and 388 and springs 386 and 387 while allowing pushbuttons 360 and 362 to slide freely.

Contact member 388 and retainer 378 are intended to have respective separate electrical leads coupled thereto through pins 394 and 384 respectively. It will be seen then that when assembled, contact member 388 and retainer 378 are electrically separated from one another when springs 386 and 387 respectively bias buttons 360 and 362 away from any contact with the ends of contact member 388. If, as by the movement of a mechanically coupled dimmer slider of magnitude sufficient to overcome the bias of the respective spring, pressure is applied to the base of either button 360 or 362, the button will move inwardly in cradle 368 along the respective one of slots 370 and 372 until the respective conductive layer 367 or 369 contacts the corresponding end of contact member 388, thereby closing the circuit between the two electrical connections. Immediately upon release of the pressure acting on a button, the corresponding spring causes that button to break the electrical circuit with contact member 388.

It will be appreciated that in an alternative embodiment, the buttons can be spring-biased in the opposite direction, i.e., normally in engagement with contact member 388 so that pressure on the button against the spring bias serves to open the circuit rather than close it.

Further embodiments of the pushbutton switch of the present invention include a switch with at least one movable contact that is pushed either toward or away from engagement with a second contact when either pushbutton is depressed. In these embodiments, there is no requirement for buttons to be faced with conductive layers. Alternatively, the switch could have two contacts that are bridged by the conductive layers on each of the pushbuttons. Depressing either of the pushbuttons would make or break the connection depending upon whether the switch was designed as normally open or normally closed. The embodiment of FIG. 5 is preferable however because the conductive layer has to make contact only with one of edges 390 or 391 rather than both simultaneously.

Figure 6:
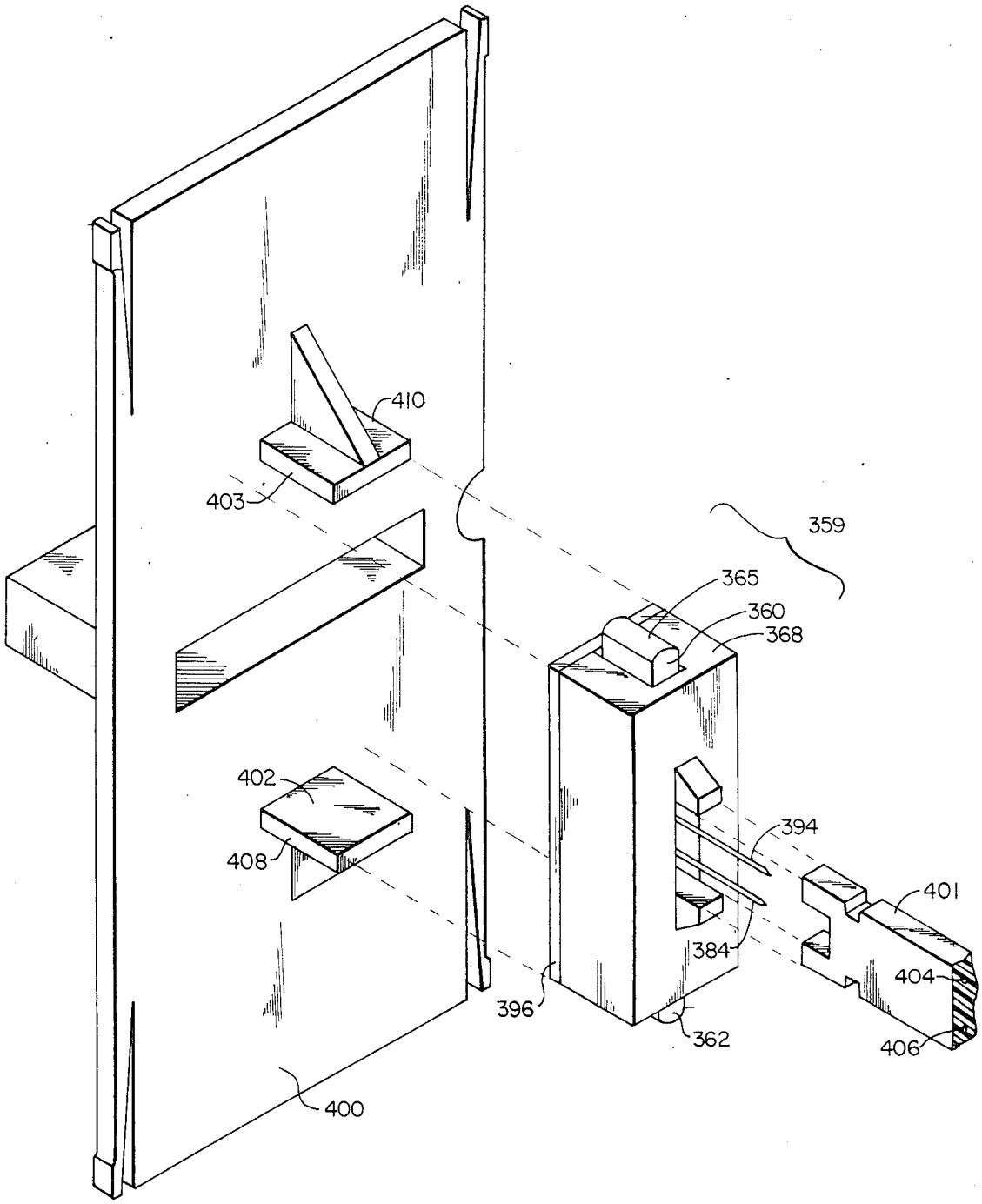
FIG. 6 is an exploded view showing a cooperative structure incorporating the push-button switch of FIG. 5, a potentiometer actuator, and a dimmer slider.

As shown in FIG. 6, the pushbutton switch of FIG. 5 is preferably used in cooperation with dimmer slider 400 and potentiometer actuator 401. Cradle 368 of switch 359 fits over the end of potentiometer actuator 401. Connector pin 384 and connector pin 394 make connection with contacts (not shown) inside potentiometer actuator shaft 401. Wires 404 and 406 are connected to these contacts and hence to connector pins 394 and 384 respectively, so as to connect switch 359 to associated circuitry through movable connections inside the potentiometer (not shown). Alternatively, switch 359 can be connected to associated circuitry with a flexible printed circuit board outside the actuator shaft.

Dimmer slider 400 fits over switch 359, with surface 403 of standoff 410 and surface 402 of standoff 408 clearing buttons 360 and 362 respectively. Dimmer slider 400 may be supported and guided generally as shown in U.S. Pat. No. 3,746,923 incorporated herein by reference.

Moving dimmer slider 400 in a downwards direction (as viewed in FIG. 6) causes surface 403 of standoff 410 to contact extended base 365 of button 360. Further motion of dimmer slider 400 will move button 360, causing conductive layer 367 to contact depending legs 390 and 391 of contact member 388, and hence close switch 359. Once conductive layer 367 has contacted depending legs 390 and 391, further motion of dimmer slider 400 in a downward direction will cause potentiometer actuator 401 to move in a downward direction, changing the potentiometer setting.

Releasing dimmer slider 400 stops downward movement of potentiometer actuator 401, and allows button 360 to return to its rest position against cradle 368 where it is held by spring 386. Similarly, upward motion of dimmer slider 400 causes button 362 to move upward, once again closing switch 359 before transferring the motion of dimmer slider 400 to potentiometer actuator 401.

Hence, by using the novel arrangement of FIG. 6 to mechanically couple switches to potentiometer actuators with the circuit of FIG. 3 or FIG. 4, transfer of control between main and remote units of a multi-location dimming system can be achieved simply by moving the dimmer slider at the desired control location. A further advantage is that control can still be transferred by moving the dimmer slider in either direction even when the potentiometer actuator is at an extreme end of its travel.

Figure 7:
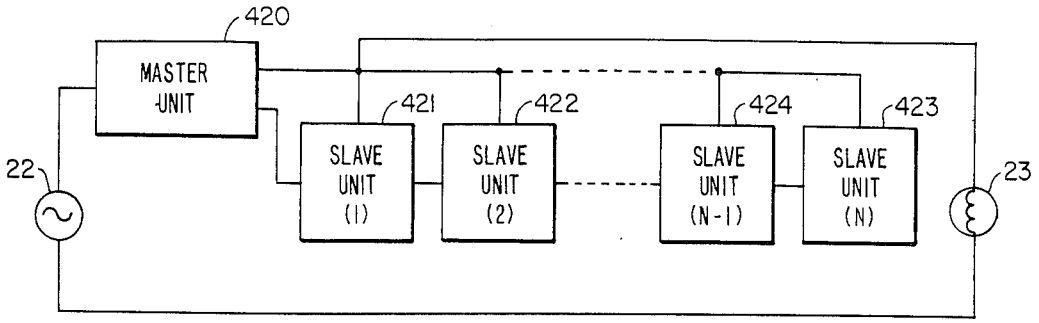
FIG. 7 is a generalized block diagram showing an embodiment of the present invention involving more than two dimmers.

As shown in FIG. 7, the principles of the present invention can be extended to a system employing two or more control units positionable at locations remote from a master control. The embodiment of FIG. 7 includes main control unit 420 connected between A.C. source 22 and load 23. Master unit 420 may typically be substantially the same circuit shown as 20 in FIG. 3. In addition, the embodiment in FIG. 7 includes first slave unit 421, second slave unit 422, nth slave unit 423 and (n-1)th slave unit 424, all of which have substantially the same circuit. The slaves are connected to each other by only two wires. The slave closest to master unit 420 is similarly connected to it with only two wires. The load wiring can be run from master unit 420 to load 23 directly as shown or one of the wires connecting the slave units can be used to carry load current as well.

Figure 8:
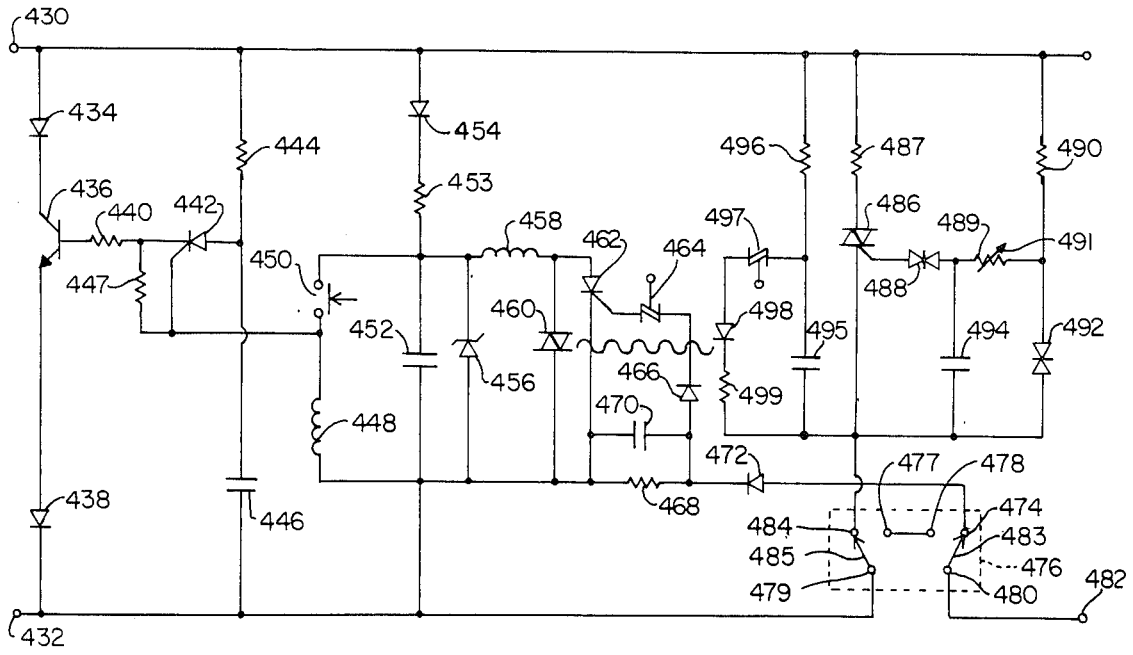
FIG. 8 is a detailed schematic of a portion of FIG. 7.

A preferred circuit for each of the slave units of FIG. 7, as shown in FIG. 8, includes a pair of end terminals 430 and 432 respectively connected to line 76 and line 81 of master unit 20 as shown in FIG. 3. Coupled in series between terminals 430 and 432 are diode 434, "take-command" transistor 436 and diode 438. Transistor 436 is typically an NPN transistor such as a 2N6517, the collector of which is connected to the cathode of diode 434 and the emitter of which is connected to the anode of diode 438. The base of transistor 436 is connected through resistor 440 to the cathode of "take-command" siliccn controlled rectifier 442. The anode of rectifier 442 is connected to the junction between resistor 444 and transistor capacitor 446. Resistor 444 and capacitor 446 are connected in series between terminals 430 and 432. The cathode of rectifier 442 is also connected through resistor 447 to the gate of rectifier 442.

The embodiment of FIG. 8 also includes relay coil 448, one end of which is connected to one contact of SPST momentary pushbutton-type switch 450, the junction of coil 448 and switch 450 being connected to the gate of rectifier 442. The other contact of switch 450 and end of coil 448 are connected across relay capacitor 452. One side of capacitor 452 is connected to terminal 432, the other side of capacitor 452 being connected through resistor 453 to the cathode of diode 454. The anode of the latter is connected to terminal 430.

Coupled in parallel with capacitor 452 is Zener diode 456, the cathode of which is connected to one end of relay coil 458, the anode of which is connected to terminal 432. Light-activated triac 460 is connected between the other end of coil 458 and terminal 432. Silicon controlled rectifier 462 is connected in parallel with triac 460, the anode of rectifier 462 being connected also to the other end of relay coil 458. The gate of rectifier 462 is connected through silicon bilateral switch 464 to the cathode of diode 466. The anode of diode 466 is connected through resistor 468 to terminal 432. Capacitor 470 is connected in parallel with resistor 468. The anode of diode 466 is also connected to the cathode of diode 472, the anode of the latter being coupled to relay contact 474 in relay section 476.

Relay section 476 further includes relay contacts 477 and 478 connected to one another, terminal 479 connected to terminal 432, and terminal 480 connected to terminal 482. Relay section 476 also includes a first relay armature 483 connected to terminal 480 and movable alternatively between engagement with relay contacts 474 and 478. Relay section 476 also includes another relay contact 484, and second relay armature 485 connected to terminal 479 and movable alternatively between engagement with terminals 484 and 477.

Armatures 483 and 485 are ganged to operate in tandem so that when armature 483 engages relay contact 474, armature 485 is in engagement with contact 484 (hereinafter referred to as the "on" position), all as shown in FIG. 8. Alternatively, when armatures 483 and 485 are in respective engagement with contacts 478 and 477 (hereinafter referred to as the "off" position), a short circuit is thereby formed between terminals 432 and 482. Relay coils 448 and 458 are disposed so that when coil 448 is energized, the resulting magnetic field toggles the relay armatures into the "on" position, and when coil 458 is energized, the relay armatures are toggled into the "off" position.

The slave unit shown in FIG. 8 also includes a phase-control pulse generator comprising pilot triac 486, one side of which is connected through resistor 487 to terminal 430, the other side of which is connected to relay contact 484. The gate of triac 486 is connected through diac 488 and series connected potentiometer 489 and resistor 490 to terminal 430. The junction of resistors 489 and 490 is connected through diac 492 to relay contact 484. The junction of diac 488 and resistor 489 is connected through capacitor 494 to relay contact 484. Potentiometer 489 includes actuator 491, typically manually manipulable for changing the vlaue of the potentiometer, and mechanically coupled to switch 450 so that the latter is operated momentarily when the dimmer slider is moved.

Series-connected between relay contact 484 and terminal 430 are capacitor 495 and resistor 496. The unction of capacitor 495 and resistor 496 is connected through silicon bilateral switch 497, light-emitting diode 498 and resistor 499 to relay contact 484.

The operation of the embodiment of FIG. 8 can advantageously be described by assuming a situation where master unit 20 is in command and the slave unit shown in FIG. 8 is passive. In such case, relay armatures 483 and 485 are in engagement with contact 478 and 477 respectively, thereby providing a short circuit between terminals 432 and 482. Inasmuch as there is an AC voltage including a net DC component across terminals 430 and 432, capacitors 446 and 452 will be charged by the current flowing through resistors 444 and 453 respectively. In other words, the control line passes through the slave unit of FIG. 8 simply as a reference to charge up the proper capacitances and connect to such other slaves as may be downstream.

Now upon closure of switch 450 by manipulation or movement of the dimmer slider coupled to potentiometer 489, capacitor 452 discharges through relay coil 448, toggling relays armatures 483 and 485 to the "on" position. Simultaneously, capacitor 446 is also discharged into the base of transistor 436 through SCR 442 which is gated on when switch 450 is closed. Thus, transistor 436 conducts, momentarily short-circuiting (through diodes 434 and 438) terminals 430 and 432 to one another, taking command from the master unit (or any other slave between the master and the slave of FIG. 8) and conferring that command on the slave unit of FIG. 8.

At this point, the phase control pulse portion of the slave unit becomes active and a current path is established from terminal 432 through relay armature 485, contact 484, and all of the other components of the phase control pulse portion to terminal 430.

Capacitor 494 charges to the breakover voltage of diac 488 on a time-dependent basis according to the setting of potentiometer 489 and the value of capacitor 494. When diac 488 conducts, it discharges capacitor 494 into the gate terminal of triac 486. The latter turns on, charging up capacitor 150 in the master (as shown in FIG. 3) until the breakover voltage of silicon bilateral switch 118 is reached, at which time current flows into gate terminal 42 of triac 24 turning it on and applying line voltage to dimmed-hot terminal 430. Thus, when the slave of FIG. 8 is in command, triac 486 serves as a signal or low current pilot triac that fires main triac 24 typically about 50 microseconds after triac 486 fires, at which time the latter turns off.

If the master unit, or another slave unit closer to the master unit is operated to take command, diode 128 in the master unit (FIG. 3) or the equivalent diode 472 in the slave unit taking command, is put into series with terminal 432 causing a net charge to be built up on capacitor 495 to the breakover voltage of silcon bilateral switch 497. The latter thus conducts and current flows through light-emitting diode 498. The light pulse from diode 498 activates triac 460 so that capacitor 452 now discharges, but through coil 458. The magnetic field of coil 458 toggles relay unit 476 into the "off" position, and the slave unit of FIG. 8 is no longer in command.

If, however, slave units more remote from the master unit are operated to take command, the dimmed hot line at terminal 430 will momentarily short to the control line at terminal 482, in a manner similar to that above described in connection with the slave unit of FIG. 3. The momentary short circuit charges capacitor 470 up to the breakover voltage of silicon bilateral switch 464, firing silicon controlled rectifier 462. This then serves to discharge capacitor 452 through relay coil 458, toggling relay unit 476 into the "off" position so that command is relinquished to the more remote slave unit.

When the more remote slave unit is in command, the voltage between terminals 430 and 432 is substantially AC with no net DC component. Thus transistor capacitor 446 does not charge up to more than 1 volt. In such case the slave unit of FIG. 8 can regain control from the more remote unit simply by toggling relay unit 476 to the "on" position. Hence, transistor capacitor 446 need not be fully charged as would be the case where the slave unit of FIG. 8 is to take command from the master unit as above described. Regaining control from the more remote unit is accomplished simply by closure of switch 450 attendant upon movement of actuator 491, thereby discharging relay capacitor 452 through relay coil 448. As earlier noted, actuation of coil 448 toggles relay section 476 into the "on" position, placing the slave unit of FIG. 8 in command. Diode 472 causes a net DC voltage to appear across the input terminals of the more remote slave units, turning them off as above described.

The preferred values of the resistors and capacitors of the embodiment of FIG. 8 are set forth in Table III below. All resistors are 0.5 W power rating unless otherwise stated.

TABLE III

| Resistor | Value (ohms) | Capacitor | Value (uf) | Rated Voltage |
|---|---|---|---|---|
| 440 | 5.6K | 446 | 4.7 | 50 |

TABLE III-continued

| Resistor | Value (ohms) | Capacitor | Value (uf) | Rated Voltage |
|---|---|---|---|---|
| 444 | 33K | 452 | 4.7 | 50 |
| 447 | 1K | 470 | 0.22 | 50 |
| 453 | 27K(1 W) | 494 | 0.047 | 250 |
| 468 | 100 | 495 | 0.33 | 50 |
| 487 | 3.3K | | | |
| 489 | 0–250K(var) | | | |
| 490 | 27K | | | |
| 496 | 470K | | | |
| 499 | 100 | | | |

Preferably, all diodes are type 1N4004; all silicon bilateral switches are Motorola MBS 4992; all silicon controlled rectifiers are Motorola MCR 22-5; triac 486 is Motorola MAC97AB. Also preferably, diac 488 is NEC 413M with a breakover voltage of 30 V and diac 492 is a Teccor H1010 with a breakover voltage of 60 V. Zener diode 456 is a type 1N5252B with a $V_z$ of 24 V. Transistor 436 is a type 2N6517. Optical triac 460 and light emitting diode 498 together are exemplified by a Motorola MOC3010. Relay section 476, relay coil 448 and relay coil 458 together are preferably in the form of an Aromat relay DS2ESL2DC12V.

It will be appreciated that the load controlled by any of the embodiments of the multiple location system of the present invention is typically an incandescent lamp or multiple lamps, but the nature of the load is not so limited, and the present invention is applicable equally to other lamp types and to other loads such as audio, video, position, velocity, acceleration, temperature, voltage, current, angular position any quantity, rate of change of a quantity, rate of change of the rate of change of a quantity and the like.

Since certain changes may be made in the above apparatus without departing from the scope of the inventions herein involved, it is intended that all matter contained in the above description or shown in the accompanying drawing shall be interpreted in an illustrative and not in a limiting sense.

What is claimed is:

1. A multiple location system for controlling application of alternating-current power to a load, said system comprising in combination:

controllable bidirectional switching means for controlling said application in accordance with control signals applied to said switching means;

means disposed at a first location for producing a first of said control signals and including a first actuator positionable for variably determining the magnitude of said first control signal at a value established substantially instantaneously upon positioning of said first actuator;

means disposed at a second location for producing a second of said control signals and including a second actuator positionable for variably determining the magnitude of said second control signal at a value established substantially instantaneously upon positioning of said second actuator; and means for automatically applying alternatively either the first or second of said control signals in accordance with the respective one of said actuators last operated, so that said power is varied to said load substantially instantaneously in accordance with the respective one of said control signals applied.

2. A multiple location system as defined in claim 1 wherein said bidirectional switching means is gate-controlled, bidirectional, semiconductor switching means for controlling said application in accordance with control signals applied to the gate of said switching means; and said means for automatically applying comprises means for connecting said gate of said semiconductor switching means to either said means for producing said first control signal or said means for producing said second control signal in accordance with the respective one of said actuators being positioned.

3. A multiple location system as defined in claim 2 wherein said switching means is a triac.

4. A multiple location system as defined in claim 3 wherein said means for producing said control signals comprises a pulse generating circuit including a trigger device for controlling the phase of the power conducted by said triac.

5. A multiple location system as defined in claim 1 wherein said bidirectional switching means is disposed at said first location.

6. A multiple location system as defined in claim 5 wherein said means for automatically applying alternatively either said first or second of said control signals is disposed at said first location.

7. A multiple location system as defined in claim 6 including means, in the form of only a pair of electrically conductive leads, provided for connecting means disposed at said first location with means disposed at said second location.

8. A multiple location system as defined in claim 1 wherein means disposed respectively at said first and second locations are dimensioned to fit within respective standard electrical wallboxes.

9. A multiple location system as defined in claim 1 wherein said means for producing said control signals comprise respective potentiometers.

10. A multiple location system as defined in claim 9 wherein at least one of said potentiometers is a rotary potentiometer.

11. A multiple location system as defined in claim 9 wherein at least one of said potentiometers is a linear potentiometer.

12. A multiple location system as defined in claim 9 wherein each of said potentiometers includes a respective variable resistance operable through a multiplicity of settings between minimum and maximum values to variably determine the magnitude of the respective control signal produced.

13. A multiple location system as defined in claim 9 including a first switch means coupled to a first of said potentiometers and actuated momentarily upon operation of said first potentiometer;

a second switch means coupled to a second of said potentiometers and actuated momentarily upon operation of said second potentiometer;

and wherein said means for connecting said gate includes third switch means, responsive alternatively to actuation of said first and second switch means, for respectively connecting said means for producing said first control signal or said means for producing said second control signal to the gate of said controllable bidirectional switching means.

14. A multiple location system as defined in claim 13 wherein each of said first and second switch means is actuated upon operation of the respective potentiometer in any direction.

15. A multiple location system as defined in claim 13 wherein each of said first and second switch means is mechanically connected to a respective potentiometer actuator so as to be actuated upon operation of said respective potentiometer.

16. A multiple location system as defined in claim 9 including means for electronically detecting operation of the first of said potentiometers;

means for electronically detecting operation of the second of said potentiometers;

and wherein said means for automatically applying alternatively either the first or second of said control signals comprises switch means responsive to said means for electronically detecting operation.

17. A multiple location system as defined in claim 1 wherein said controllable bidirectional switching means is disposed remotely from both said first and second locations.

18. A multiple location system as defined in claim 1 including at least one airgap switch in series with said controllable bidirectional switching means.

19. A multiple location system as defined in claim 1 including electrically conductive leads coupling means disposed at said first location with means disposed at said second location, wherein the power carried by said leads is at a level substantially below the level of said alternating-current power to said load.

20. A multiple location system as defined in claim 1 including additional means disposed at separate remote locations, each being adapted to produce corresponding additional ones of said control signals and each including a respective actuator positionable for variably determining the magnitude of said corresponding one of said control signals at a value established substantially instantaneously upon positioning of said respective actuator; and means for automatically applying alternatively only one of said control signals in accordance with the respective one of said actuators last operated, so that said power is varied to said load substantially instantaneously in accordance with the respective one of said control signals applied.

21. A multiple location system as defined in claim 1 wherein said control signals are phase controlled signals with respect to the phase of the voltage of said alternating-current power.

22. A multiple location system as defined in claim 1 wherein said means for applying includes a microcomputer.

23. A multiple location system as defined in claim 9 including a first piezoelectric element coupled to a first of said potentiometers for producing a first take-command signal upon operation of said first potentiometer;

a second piezoelectric element coupled to a second of said potentiometers for producing a second take-command signal upon operation of said second potentiometer; and said means for connecting said gate includes switch means, responsive alternatively to said take-command signals, for respectively connecting said means for producing said first control signal or said means for producing said second control signal to the gate of said controllable bidirectional switching means.

24. A multiple location system as defined in claim 13 wherein said first and second switch means are actuated on operation of the respective potentiometer in any direction when the respective potentiometer actuator is at one of the extreme ends of its travel.

25. A multiple location system as defined in claim 13 including electrically conductive wires, a portion of which are contained within the respective potentiometer actuator, for making electrical connection to said first and second switch means.

26. A multiple location system for controlling application of alternating-current power to a load, said system comprising in combination:

controllable, electrically-conductive, power-controlling means having a control electrode and being positionable at a first location for controlling flow of said power through said conductive means in accordance with the value of control signals applied at said electrode;

means disposed at said first location for generating a first of said control signals and including a first actuator positionable for variably determining the magnitude of said first control signal at a value established substantially instantaneously upon positioning of said first actuator;

means disposed at a second location for producing a second of said control signals and including a second actuator positionable for variably determining the magnitude of said second control signal at a value established substantially instantaneously upon positioning of said second actuator and independently of the position of said first actuator;

the value of said first control signal being independent of the position of said second actuator;

electrically conductive wire means consisting of not more than two wires for connecting means at said first location with means at said second location;

means for applying alternatively either the first or second of said control signals to said control electrode so that said power is varied to said load substantially instantaneously in accordance with the respective one of said control signals applied.

27. A multiple location system as defined in claim 26 wherein said power controlling means is a triac.

28. A multiple location system as defined in claim 26 wherein means disposed respectively at said first and second locations are dimensioned to fit within respective standard electrical wallboxes.

29. A multiple location system as defined in claim 26 wherein said means for producing said control signals comprise respective potentiometers, and said actuators are the operating members of said potentiometers.

30. A multiple location system as defined in claim 29 wherein at least one of said potentiometers is a rotary potentiometer.

31. A multiple location system as defined in claim 29 wherein at least one of said potentiometers is a linear potentiometer.

32. A multiple location system as defined in claim 29 including a first momentarily operable switch means at said first location and a second momentarily operable switch means at said second location, either the first or the second of said control signals being applied to said control electrode in acordance with the respective one of said switches last operated.

33. A multiple location system as defined in claim 32 wherein said first and second switch means are coupled to said actuators.

34. A multiple location system as defined in claim 33 wherein said first and second switch means are operated automatically on operation of said potentiometers.

35. A multiple location system as defined in claim 26 including a first momentarily operable switch means at said first location and a second momentarily operable switch means at said second location, either the first or the second of said control signals being applied to said control electrodes in accordance with the respective one of said switches last operated.

36. A multiple location system as defined in claim 26 including at least one airgap switch in series with said controllable, electrically-conductive, power-controlling means.

37. A multiple location system as defined in claim 26 including electrically conductive leads coupling means disposed at said first location with means disposed at said second location, wherein the power carried by said leads is at a level substantially below the level of said alternating-current power to said load.

38. A multiple location system as defined in claim 26 including additional means disposed at other separate remote locations, each being adapted to produce corresponding additional ones of said control signals and each including a respective actuator positionable for variably determining the magnitude of said corresponding one of said control signals at a value established substantially instantaneously upon positioning of said respective actuator; and means for applying alternatively only one of said control signals to said control electrode so that said power is varied to said load substantially instantaneously in accordance with the respective one of said control signals applied.

39. A multiple location system as defined in claim 26 wherein said control signals are phase-controlled signals with respect to the phase of the voltage of said alternating-current power.

40. A momentary push-button type switch comprising, in combination electically insulating, hollow enclosure means having openings at opposite ends thereof, each of said openings having positioned therein an electrically insulating pushbutton movable substantially toward and away from each other;

means for resiliently biasing said pushbuttons relative to one another;

a first electrical contact and a second electrical contact in normally-closed electrical connection with one another;

means for mounting said pushbuttons and contacts so that movement of either of said pushbuttons in its respective opening against the bias of said means for resiliently biasing opens said normally-closed connection between said contacts.

41. A momentary push-button type switch as defined in claim 40 wherein each of said pushbuttons has an electrically conductive layer attached to a respective surface without adhesive.

42. A momentary push-button type switch as defined in claim 40 wherein each of said pushbuttons has an electrically conductive layer disposed on a respective surface thereof in electrical connection with said first and second contacts so that movement of either of said pushbuttons in its respective opening against the bias of said means for resiliently biasing breaks the connection between the respective one of said layers and said first and second contacts.

43. A momentary push-button type switch as defined in claim 40 wherein each of said pushbuttons has an electrically conductive layer disposed on a respective surface thereof;

said means for resiliently biasing is electrically conductive and electrically connects each respective one of said layers to said first contact; and each of said layers is further connected to said second contact so that movement of either of said pushbuttons in its respective opening against the bias of said means for resiliently biasing opens the connection between the respective one of said layers and said second contact.

44. A momentary push-button type switch as defined in claim 40 including means formed by part of said enclosure means for preventing overtravel of said pushbuttons.

45. A momentary push-button type switch as defined in claim 40 including a potentiometer actuator and a slider; and means mechanically coupling said slider and said actuator to said switch so that motion of said slider momentarily opens said normally-closed electrical connection between said contacts before transferring said motion to said actuator.

46. A momentary push-button type switch as defined in claim 45 wherein each of said pushbuttons has an electrically conductive layer disposed on a respective surface thereof in electrical connection with said first and second contacts so that movement of either of said pushbuttons in its respective opening against the bias of said means for resiliently biasing opens the connection between the respective one of said layers and said first and second contacts.

47. A momentary push-button type switch as defined in claim 45 wherein:

each of said pushbuttons has an electrically conductive layer disposed on a respective surface thereof;

said means for resiliently biasing is electrically conductive and electrically connects each respective one of said layers to said first contact; and each of said layers is further connected to said second contact so that movement of either of said pushbuttons in its respective opening against the bias of said means for resiliently biasing opens the connection between the respective one of said layers and said second contact.

48. A momentary push-button type switch comprising, in combination electrically insulating, hollow enclosure means having openings at opposite ends thereof, each of said openings having positioned therein an electrically insulating pushbutton movable substantially toward and away from each other;

means for resiliently biasing said pushbuttons relative to one another;

a first electrical contact and a second electrical contact in normally-open electrical connection with one another;

means for mounting said pushbuttons and contacts so that movement of either of said pushbuttons in its respective opening against the bias of said means for resiliently biasing closes said normally-open connection between said contacts.

49. A momentary push-button type switch as defined in claim 48 wherein each of said pushbuttons has an electrically conductive layer attached to a respective surface without adhesive.

50. A momentary push-button type switch as defined in claim 48 wherein each of said pushbuttons has an electrically conductive layer disposed on a respective surface thereof so that movement of either of said pushbuttons in its respective opening against the bias of said means for resiliently biasing closes the connection between the respective one of said layers and said first and second contacts.

51. A momentary push-button type switch as defined in claim 48 wherein each of said pushbuttons has an electrically conductive layer disposed on a respective surface thereof;

said means for resiliently biasing is electrically conductive and electrically connects each respective one of said layers to said first contact; and each of said layers is further connected to said second contact only when movement of either of said pushbuttons in its respective opening against the bias of said means for resiliently biasing closes the connection between the respective one of said layers and said second contact.

52. A momentary push-button type switch as defined in claim 48 including means formed by part of said enclosure means for preventing over-travel of said pushbuttons.

53. A momentary push-button type switch as defined in claim 48 including a potentiometer actuator and a slider; and means mechanically coupling said slider and said actuator to said switch so that motion of said slider momentarily closes said normally-open electrical connection between said contacts before transferring said motion to said actuator.

54. A momentary push-button type switch as defined in claim 53 wherein each of said pushbuttons has an electrically conductive layer disposed on a respective surface thereof so that movement of either of said pushbuttons in its respective opening against the bias of said means for resiliently biasing closes the connection between the respective one of said layers and said first and second contacts.

55. A momentary push-button type switch as defined in claim 53 wherein:

each of said pushbuttons has an electrically conductive layer disposed on a respective surface thereof;

said means for resiliently biasing is electrically conductive and electrically connects each respective one of said layers to said first contact; and each of said layers is further connected to said second contact only when movement of either of said pushbuttons in its respective opening against the bias of said means for resiliently biasing closes the connection between the respective one of said layers and said second contact.

56. A multiple location system for controlling application of alternating-current power to a load, said system comprising in combination:

a master unit including:

controllable, electrical power-handling means having a control electrode for controlling flow of said power through said power-handling means in accordance with the value of control signals applied at said electrode;

means for producing a first of said control signals and including a first actuator movable for variably determining the magnitude of said first control signal over a continuous range of values, the value of said first control signal being established by the position of said first actuator and substantially instantaneously upon positioning of said first actuator; and switching means moveable between a first and a second position;

main operating means for moving said switching means between said first and second positions responsively to signals;

a remote unit including:

means for producing a second of said control signals and including a second actuator positionable for variably determining the magnitude of said second control signal over a continuous range of values, the value of said second control signal being established by the position of said second actuator and substantially instantaneously upon positioning of said second actuator; and a auxiliary operating means responsive to signals produced by movement of said second actuator for producing an output signal at the output of said auxiliary operating means;

said main operating means being connected to be actuated responsively to signals produced by movement of said first actuator and to signals from said auxiliary operating means, so that upon movement of said switching means by said main operating means into said first position, said first control signal is applied to said control electrode and said main operating means is connected to the output of said auxiliary operating means, and upon movement of said switching means by said main operating means into said second position, said second control signal is applied to said control electrode and said main operating means is disconnected from the output of said auxilary operating means.

57. A multiple location system as defined in claim 56 wherein said means for producing said control signals include potentiometers.

58. A multiple location system as defined in claim 57 wherein at least one of said potentiometers is a linear potentiometer.

59. A multiple location system as defined in claim 56 wherein movement of said first actuator causes said operating means to move said switching means to said first position.

60. A multiple location system as defined in claim 56 wherein movement of said second actuator causes said operating means to move said switching means to said second position.

61. A multiple location system as defined in claim 56 including means, in the form of only a pair of electrically conductive leads, for connecting said master unit and said remote unit to one another.

62. A multiple location system for producing a variable output signal, said system comprising in combination:

means disposed at a first location for producing a first control signal and including a first actuator positionable for variably determining the magnitude of said first control signal at a value established substantially instantaneously upon positioning of said first actuator;

means disposed at a second location for producing a second control signal and including a second actuator positionable for variably determining the magnitude of said second control signal at a value established substantially instantaneously upon positioning of said second actuator;

means for producing a variable output signal responsively to application of said control signals; and means for automatically applying to said means for producing, alternatively either the first or second of said control signals system in accordance with the respective one of said actuators last operated, so that said output signal is variable substantially instantaneously in accordance with the respective one of said control signals applied.

63. A multiple location system as defined in claim 62 wherein said means for producing said control signals comprise respective potentiometers.

64. A multiple location system as defined in claim 63 wherein at least one of said potentiometers is a linear potentiometer.

65. A multiple location system as defined in claims 62 and 64 wherein said output signal controls the volume level of an audio signal.

66. A multiple location system as defined in claims 62 and 64 wherein said output signal controls the brightness level of a television picture.

67. A multiple location system as defined in claim 6 including protective means for protecting means at said first location and means at said second location from damage under miswire conditions.

68. A multiple location system as defined in claim 13 or claim 33 including a flexible printed circuit board for making electrical connection to said first and second switch means.

69. A multiple location system as defined in claim 33 including electrically conductive wires, a portion of which are contained within the respective potentiometer actuator, for making electrical connection to said first and second switch means.

70. A multiple location system as defined in claim 67 wherein said protective means includes a power resistor.

* * * * *

UNITED STATES PATENT AND TRADEMARK OFFICE

CERTIFICATE OF CORRECTION

PATENT NO. : 4,689,547

DATED : August 25, 1987

INVENTOR(S) : Michael J. Rowen, et al.

It is certified that error appears in the above-identified patent and that said Letters Patent is hereby corrected as shown below:

Claim 26, column 23, line 37, after "location;", insert -- and --;

Claim 32, column 23, line 64, delete "acordance" and substitute therefor -- accordance --;

Claim 40, column 24, line 41, delete "electically" and substitute therefor -- electrically --;

Claim 40, column 24, line 50, after "another;", insert -- and --;

Claim 48, column 25, line 59, after "another;", insert -- and --;

Claim 56, column 27, line 3, delete "and";

Claim 56, column 27, line 5, after "position;", insert -- and --;

Claim 56, column 27, line 8, after "signals;", insert -- and --;

UNITED STATES PATENT AND TRADEMARK OFFICE

CERTIFICATE OF CORRECTION

PATENT NO. : 4,689,547

DATED : August 25, 1987

INVENTOR(S) : Michael J. Rowen, et al.

It is certified that error appears in the above-identified patent and that said Letters Patent is hereby corrected as shown below:

Claim 56, column 27, line 17, delete "a";

Claim 56, column 27, line 35, delete "auxilary" and substitute therefor -- auxiliary --; and Claim 62, column 28, line 20, delete "system".

Signed and Sealed this

Second Day of February, 1988

*Attest:*

DONALD J. QUIGG

*Attesting Officer*

*Commissioner of Patents and Trademarks*